US009388516B2

(12) United States Patent
Miyauchi et al.

(10) Patent No.: US 9,388,516 B2
(45) Date of Patent: Jul. 12, 2016

(54) METHOD FOR PRODUCING CARBON-FIBER-PRECURSOR ACRYLIC FIBER BUNDLE

(75) Inventors: Akira Miyauchi, Aichi (JP); Isao Ooki, Hiroshima (JP); Yukihiro Mizutori, Hiroshima (JP); Akishige Tada, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 291 days.

(21) Appl. No.: 14/123,361

(22) PCT Filed: May 31, 2012

(86) PCT No.: PCT/JP2012/064146

§ 371 (c)(1),
(2), (4) Date: Dec. 2, 2013

(87) PCT Pub. No.: WO2012/165574

PCT Pub. Date: Dec. 6, 2012

(65) Prior Publication Data

US 2014/0115848 A1 May 1, 2014

(30) Foreign Application Priority Data

Jun. 3, 2011 (JP) ..... 2011-125253

(51) Int. Cl.
*D02J 1/18* (2006.01)
*D02J 1/22* (2006.01)
(Continued)

(52) U.S. Cl.
CPC ..... *D02J 1/227* (2013.01); *D01D 11/02* (2013.01); *D01H 5/22* (2013.01); *D02J 1/18* (2013.01); *D02J 1/222* (2013.01); *D01F 6/18* (2013.01); *D01F 9/22* (2013.01)

(58) Field of Classification Search
CPC ..... D01D 11/02; D02J 1/18; D02J 1/222; D02J 1/221; D02J 1/229; D02J 13/001; D02J 1/227
USPC ..... 28/282, 283, 246
See application file for complete search history.

(56) References Cited

U.S. PATENT DOCUMENTS 3,120,027 A * 2/1964 Baggett ..... D01D 5/08 118/410
3,255,506 A * 6/1966 Fritz ..... A24D 3/0204 156/152

(Continued)

FOREIGN PATENT DOCUMENTS

JP 61 231213 10/1986
JP 7 70862 3/1995

(Continued)

OTHER PUBLICATIONS

English language machine translation of JP 1112874, document publication date Jan. 19, 1999, translation 17 pages.*

(Continued)

*Primary Examiner* — Amy Vanatta
(74) *Attorney, Agent, or Firm* — Oblon, McClelland, Maier & Neustadt, L.L.P.

(57) ABSTRACT

A steam-drawing apparatus has supply roll 1 that transfers carbon-fiber-precursor acrylic fiber bundle (T) in a transfer direction of fiber bundle (T); fiber-opening device 2 for opening fiber bundle (T); width control device 3 for controlling the width of fiber bundle (T); steam box 4 to provide steam for heating fiber bundle (T) to a temperature that allows fiber bundle (T) to be drawn; and haul-off roll 5 that transfers fiber bundle (T) at a speed faster than that of supply roll 1. Using width control device 3 provided at a position between supply roll 1 and steam box 4, the width of fiber bundle (T) after passing through width control device 3 is set to be 65~110% of the width of fiber bundle (T) before entering the supply roll. The present invention proposes a method for producing a carbon-fiber-precursor acrylic fiber bundle using such a steam-drawing apparatus capable of conducting a high-speed drawing process of carbon-fiber-precursor acrylic fiber bundles at a high draw rate with stable results.

17 Claims, 4 Drawing Sheets

(51) Int. Cl.

| | |
|---|---|
| ***D01D 11/02*** | (2006.01) |
| ***D01H 5/22*** | (2006.01) |
| *D01F 6/18* | (2006.01) |
| *D01F 9/22* | (2006.01) |

(56) References Cited

U.S. PATENT DOCUMENTS

| | | | | | |
|---|---|---|---|---|---|
| 3,287,784 | A * | 11/1966 | Loftin | A24D 3/0204 | 19/0.46 |
| 3,380,131 | A * | 4/1968 | Gray | C12N 1/10 | 19/65 T |
| 3,535,745 | A * | 10/1970 | Zeidman | D01D 11/02 | 28/283 |
| 3,546,722 | A * | 12/1970 | Watson | D04H 1/005 | 19/66 T |
| 4,571,793 | A * | 2/1986 | Price | D02G 1/165 | 264/289.6 |
| 6,543,106 | B1 * | 4/2003 | Ames | D02G 1/122 | 19/66 T |
| 7,536,761 | B2 * | 5/2009 | Nestler | D02J 1/18 | 28/220 |
| 2014/0123713 | A1 * | 5/2014 | Mizutori | D01F 6/18 | 68/5 E |
| 2014/0201961 | A1 * | 7/2014 | Tada | D02J 1/222 | 28/246 |

FOREIGN PATENT DOCUMENTS

| | | |
|---|---|---|
| JP | 11 12874 | 1/1999 |
| JP | 11 286845 | 10/1999 |
| JP | 2002 309438 | 10/2002 |

OTHER PUBLICATIONS

English language machine translation of JP 2002309438, document publication date Oct. 23, 2002, translation 13 pages.*

International Search Report Issued in Jul. 17, 2012 PCT/JP12/064146 Filed May 31, 2012.

* cited by examiner

METHOD FOR PRODUCING CARBON-FIBER-PRECURSOR ACRYLIC FIBER BUNDLE

TECHNICAL FIELD

The present invention relates to a method for producing a carbon-fiber-precursor acrylic fiber bundle using a steam drawing apparatus.

BACKGROUND ART

Acrylic fiber bundles are widely used as carbon-fiber precursors. When producing carbon-fiber-precursor acrylic fiber bundles, methods are generally known such as drawing carbon-fiber-precursor acrylic fiber bundles while continuously moving the bundles in one direction using a steam drawing apparatus.

By steam drawing carbon-fiber-precursor acrylic fiber bundles, a high draw ratio is achieved with less fuzz and end breakage, and productivity is enhanced.

Also, as for generally known methods for producing a carbon-fiber-precursor acrylic fiber bundle to obtain high-resistance carbon fibers, oil agents are applied to the fiber during an upper-stream production process using a steam-drawing apparatus and then the fiber is dried for fiber densification.

However, in a drying densification step, it is thought that oil agents cause pseudo-bonding among single yarns of a carbon-fiber-precursor acrylic fiber bundle, thus uniform penetration of steam into the fiber bundle is blocked and the plasticizing effects of the steam are not achieved uniformly in the fiber bundle. Accordingly, it is thought that uniform drawing performance by a steam-drawing apparatus is lowered, causing fuzz and breakage of the fiber bundle. To avoid such pseudo-bonding, for example, Japanese Laid-Open Patent Publication No. H11-286845 (patent publication 1) discloses a method for conducting opening treatment on acrylic filament yarn using a fluid before introducing the yarn into a steam box.

In addition, as described in Japanese Laid-Open Patent Publication No. H07-70862 (patent publication 2), prior to steam-drawing a carbon-fiber-precursor acrylic fiber bundle in a pressurized steam-drawing room, the fiber bundle is squeezed by a yarn squeezing device shortly before being introduced into a steam box. Accordingly, stable draw results are achieved.

PRIOR ART PUBLICATION

Patent Publication

Patent publication 1: Japanese Laid-Open Patent Publication No. H11-286845

Patent publication 2: Japanese Laid-Open Patent Publication No. H07-70862

SUMMARY OF THE INVENTION

Problems to be Solved by the Invention

In a steam-drawing apparatus described in patent publication 1, the pressure of a fiber-opening nozzle is described, but its structure is not described.

Also, patent publication 1 describes a method for setting the tension of a yarn at 0.01~0.09 g/d depending on the distance between the rolls positioned shortly before and after the fiber-opening device so as to achieve excellent opening effects and to prevent the yarn from meandering. However, during the process of controlling the yarn tension, slipping occurs between the yarn and the rolls positioned before and after the fiber-opening device, causing damage to the yarn. Especially, when spinning speeds are set high, the strength of the carbon fibers is lowered and fuzzy fibers are observed.

In addition, the steam-drawing apparatus described in patent publication 1 does not have a mechanism to control the width of a carbon-fiber-precursor acrylic fiber bundle. Therefore, during a process of using a fluid to open fibers, convergence properties of a carbon-fiber-precursor acrylic fiber bundle tend to be lost, causing problems such as varied width and unstable moving position of the fiber bundle, breakage of the fiber bundle and the like.

Accordingly, the carbon-fiber-precursor acrylic fiber bundle is likely to make contact with an adjacent fiber bundle or wall surfaces in the steam box and cause breakage or decreased strength of the fiber bundle, making it difficult to achieve uniform draw results in industrial applications. In addition, the carbon-fiber-precursor acrylic fiber bundle may have varied thickness, making it also difficult to achieve uniform draw results in the steam box.

Also, in the steam-drawing apparatus described in patent publication 2, the width of a carbon-fiber-precursor acrylic fiber bundle is controlled only by a yarn-squeezing device positioned shortly before the steam box. Thus, the yarn thickness may vary and cause irregular draw results in the steam box or friction between the yarn and the yarn-squeezing device. Especially, when spinning speeds are set high, fuzz may occur and the strength of subsequently produced carbon fibers tends to decrease.

The objective of the present invention is to provide a method for producing a carbon-fiber-precursor acrylic fiber bundle using a steam-drawing apparatus capable of conducting a high-speed drawing process of carbon-fiber-precursor acrylic fiber bundles at a high draw rate with stable results.

Solutions to the Problems

The method for producing a carbon-fiber-precursor acrylic fiber bundle according to an embodiment of the present invention is characterized by the following.

Namely, the method for producing a carbon-fiber-precursor acrylic fiber bundle according to an embodiment of the present invention includes a step for opening a carbon-fiber-precursor acrylic fiber bundle using an opening device that opens fibers by jet-spraying a fluid from a jet-spray nozzle, and a step for introducing the carbon-fiber-precursor acrylic fiber bundles into a steam box for heating. A gas is used as the fluid that is jet-sprayed from the jet-spray nozzle, and the flow rate of the gas is set to be at least 7 NL/min but no greater than 16 NL/min per 1000 dtex and the flow speed of the gas is set to be at least 130 m/sec but no faster than 350 m/sec.

In the method for producing a carbon-fiber-precursor acrylic fiber bundle according to an embodiment of the present invention, the nozzle aperture of the fluid jet-spray nozzle is structured to be a slit set to be long in a width direction of a carbon-fiber-precursor acrylic fiber bundle, and ratio (W1/W2) of nozzle aperture width (W1) of the fluid jet-spray nozzle to width (W2) of the fiber bundle on a roll positioned shortly before the fiber-opening device is preferred to be at least 1.2 but no greater than 2.0.

In the method for producing a carbon-fiber-precursor acrylic fiber bundle according to an embodiment of the present invention, a wrap angle of a carbon-fiber-precursor acrylic fiber bundle to rolls positioned shortly before and after the fiber-opening device is preferred to be at least 90 degrees but no greater than 200 degrees.

In the method for producing a carbon-fiber-precursor acrylic fiber bundle according to an embodiment of the present invention, the diameters of the rolls positioned before and after the opening device are set to be at least 300 mm but no greater than 600 mm.

In the method for producing a carbon-fiber-precursor acrylic fiber bundle according to an embodiment of the present invention, a fluid impingement plate is preferred to be provided in the direction at which the fluid is jet-sprayed.

In the method for producing a carbon-fiber-precursor acrylic fiber bundle according to an embodiment of the present invention, a width control device is used. Such a width control device is a roll which has grooves formed in a circumferential direction and is positioned at least 50 mm but no more than 1000 mm away from the fiber-opening device in a fiber transfer direction, and the grooves that make contact with both end portions in a width direction of a carbon-fiber-precursor acrylic fiber bundle are shaped to be a cross-sectional part of an arc or ellipse. It is preferred to introduce a carbon-fiber-precursor acrylic fiber bundle into the steam box by setting the bundle width shortly after the fiber bundle passes through the width control device to be 65~110% of the width of the fiber bundle shortly before the fiber bundle enters a supply roll.

In the method for producing a carbon-fiber-precursor acrylic fiber bundle according to an embodiment of the present invention, the groove roll is preferred to be a rotating roll.

In the method for producing a carbon-fiber-precursor acrylic fiber bundle according to an embodiment of the present invention, it is preferred to raise the temperature of a carbon-fiber-precursor acrylic fiber bundle to 80~160° C. using a hot roll after the fiber bundle passes through the width control device but before it enters the steam box.

In the method for producing a carbon-fiber-precursor acrylic fiber bundle according to an embodiment of the present invention, it is an option to provide a flat roll between the fiber-opening device and the width control device.

Effects of the Invention

When a carbon-fiber-precursor acrylic fiber bundle is drawn using a method according to an embodiment of the present invention, a high draw rate is achieved with stable draw results.

MODE TO CARRY OUT THE INVENTION

In the following, a preferred embodiment of the present invention is described in detail with reference to the drawings.

Figure 1:
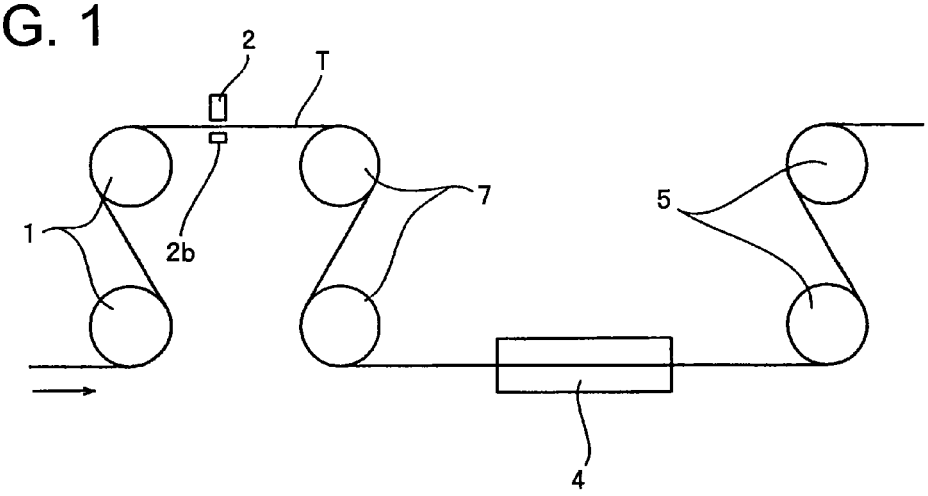
FIG. 1: a side view schematically showing the entire structure of a steam-drawing apparatus applied in a method for producing a carbon-fiber-precursor acrylic fiber bundle according to a preferred embodiment of the present invention.

FIG. 1 is a view schematically showing the entire structure of a steam-drawing apparatus applied to the method for producing a carbon-fiber-precursor acrylic fiber bundle related to the present invention. As shown in FIG. 1, the steam-drawing apparatus for drawing a carbon-fiber-precursor acrylic fiber bundle of the present embodiment (hereinafter simply referred to as "drawing apparatus") has supply roll 1 to transfer carbon-fiber-precursor acrylic fiber bundle (T) in a transfer direction, fiber-opening device 2 to open carbon-fiber-precursor acrylic fiber bundle (T), transfer roll 7 to transfer carbon-fiber-precursor acrylic fiber bundle (T), steam box 4 to supply steam to heat carbon-fiber-precursor acrylic fiber bundle (T) to a temperature at which carbon-fiber-precursor acrylic fiber bundle (T) is drawn, and haul-off roll 5 to haul off carbon-fiber-precursor acrylic fiber bundle (T) at a speed faster than the transfer speed of supply roll 1.

Well-known methods may be employed for steps before and after steam-drawing. For example, for solution spinning of carbon-fiber-precursor acrylic fibers, an acrylonitrile-based homopolymer, or acrylonitrile-based copolymer containing comonomers, is used as a raw-material polymer to prepare a stock solution by dissolving the polymer in a well-known organic or inorganic solvent. After the spinning step, a steam-drawing treatment according to the present embodiment is applied for a drawing process. In such a case, so-called wet, dry-wet or dry spinning may be employed, and then solvent removal, bath-drawing, oil attachment, drying and the like are performed in subsequent steps. A steam-drawing process may be conducted at any of such steps, but it is preferred to be performed after the solvent in the yarn is mostly removed, namely, after washing or bath drawing, or after drying, if it is a solution spinning method. In addition, although any type of oil agent may be used, a silicone-based oil agent is especially effective to achieve the effects of the present invention.

Fiber-opening device 2 of the present embodiment is preferred to be used by jet-spraying a fluid onto carbon-fiber-precursor acrylic fiber bundle (T) so that the fluid penetrates through carbon-fiber-precursor acrylic fiber bundle (T) to open the fiber bundle. For a fluid to penetrate through carbon-fiber-precursor acrylic fiber bundle (T), the flow rate of gas from a fluid jet-spray nozzle is preferred to be set at 7 NL/min or greater but 16 NL/min or less per 1000 dtex, and the flow speed at 130 m/sec or faster but 350 m/sec or slower. Considering the ease of processing fiber opening treatment, the flow rate is further preferred to be 10 NL/min or greater but 14 NL/min or less and the flow speed at 150 m/sec or faster but 320 m/sec or slower, even more preferably 230 m/sec or slower. In addition, since entanglement makes it difficult to draw fiber uniformly in a drawing apparatus, it is preferred to employ a no-entanglement structure.

Figure 2:
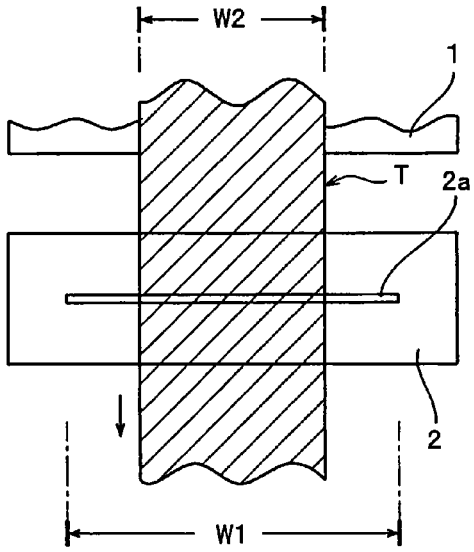
FIG. 2: a plan view showing the relationship of the slit of a fluid jet-spray nozzle of a fiber-opening device related to the present invention and the moving position of a carbon-fiber-precursor acrylic fiber bundle.

For example, as shown in FIG. 2, by jet-spraying a fluid from nozzle aperture (2*a*) that opens in a slit shape set to be long in a width direction of carbon-fiber-precursor acrylic fiber bundle (T), carbon-fiber-precursor acrylic fiber bundle (T) is opened uniformly in its width direction so as to be drawn uniformly in a steam box. At that time, either gas or liquid may be used as the fluid to be jet-sprayed from nozzle aperture (2*a*), but gas is preferred because damage to the fiber is less likely to occur and uniform fiber opening is achieved.

The type of gas is not limited specifically. For ease of handling and cost performance, air is preferred.

When carbon-fiber-precursor acrylic fiber bundle (T) is opened using fiber-opening device 2, the width of carbon-fiber-precursor acrylic fiber bundle (T) is enlarged. Ratio (W1/W2) of nozzle aperture width (W1) of the fluid jet-spray nozzle to width (W2) of carbon-fiber-precursor acrylic fiber bundle (T) on roll 1 positioned shortly before the fiber-opening device is preferred to be at least 1.2 but no greater than 2.0.

At rolls (1, 7) positioned shortly before and after fiber-opening device 2, a wrap angle of carbon-fiber-precursor acrylic fiber bundle (T) to the rolls is preferred to be set at least 90 degrees but no greater than 210 degrees. When set at such an angle, slipping is prevented between carbon-fiber-precursor acrylic fiber bundle (T) and rolls (1, 7) positioned shortly before and after fiber-opening device 2 because of the tension generated during opening of carbon-fiber-precursor acrylic fiber bundle (T). Accordingly, damage to carbon-fiber-precursor acrylic fiber bundle (T) is reduced.

In addition, the diameters of rolls (1, 7) positioned shortly before and after the fiber-opening device are preferred to be set at 300 mm or greater but 600 mm or less. When set at such a size, slipping is prevented between carbon-fiber-precursor acrylic fiber bundle (T) and rolls (1, 7) positioned shortly before and after fiber-opening device 2 because of the tension generated during the opening of carbon-fiber-precursor acrylic fiber bundle (T). Accordingly, damage to carbon-fiber-precursor acrylic fiber bundle (T) is reduced.

When a fluid is jet-sprayed from a fluid jet-spray nozzle to the yarn, since carbon-fiber-precursor acrylic fiber bundle (T) is pushed in a direction opposite that of the jet-spray nozzle, fluid impingement plate (2*b*) is preferred to be provided in the direction at which a fluid is jet-sprayed from the jet-spray nozzle. When fiber-opening device 2 is equipped with fluid impingement plate (2*b*), current is generated between the jet-spray nozzle and carbon-fiber-precursor acrylic fiber bundle (T) and between carbon-fiber-precursor acrylic fiber bundle (T) and fluid impingement plate (2*b*), resulting in efficient fiber opening.

Figure 4:
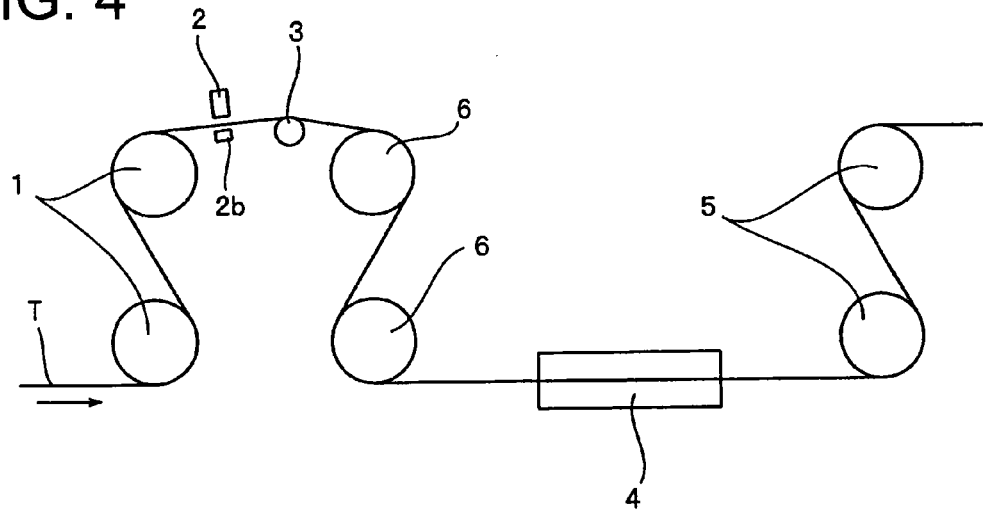
FIG. 4: a side view schematically showing the entire structure of a steam-drawing apparatus according to yet another embodiment of the present invention.

Since after such fiber opening treatment, carbon-fiber-precursor acrylic fiber bundle (T) loses its convergence property and is easily spread or split, the width of carbon-fiber-precursor acrylic fiber bundle (T) may vary or split when positioned on transfer roll 7 or when entering steam box 4. Thus, it may be difficult to perform stable drawing. In such a case, it is an option for the drawing apparatus of the present embodiment to have width control device 3 positioned after fiber-opening device 2 as shown in FIG. 4. After opening treatment, by setting width control device 3 to be positioned after fiber-opening device 2, the width of carbon-fiber-precursor acrylic fiber bundle (T) is prevented from widening, or from varying or splitting. Moreover, by controlling carbon-fiber-precursor acrylic fiber bundle (T) to have a uniform thickness and width, uniform drawing results in steam box 4 are achieved.

For width control device 3 of the present embodiment, a rotary driver roll, free roll or fixed roll with grooves formed parallel to a circumferential direction, a guide with grooves formed thereon and the like may be used. A free roll with grooves formed parallel to a circumferential direction is preferred since such a roll can suppress damage from friction to carbon-fiber-precursor acrylic fiber bundle (T), and high-quality highly durable carbon fiber is obtained.

As for the grooves of width control device 3 which makes contact with carbon-fiber-precursor acrylic fiber bundle (T), they are preferred to be in an arc shape or part of an elliptic shape to obtain a uniform fiber thickness. As long as the thickness of carbon-fiber-precursor acrylic fiber bundle (T) is made uniform and does not cause friction with the fiber, it is an option to form part of a groove to be flat. In such a case, a flat surface and a curved surface are preferred to be smoothly connected.

The material of width control device 3 is not limited specifically as long as it is a smooth material that does not damage carbon-fiber-precursor acrylic fibers. However, stainless steel, titanium and ceramics are preferred in view of durability. It is an option for their surfaces to be a satin finish or plated.

Steam with a vapor pressure set to be saturated at the inner pressure of steam box 4 is supplied to steam box 4 to plasticize the polymer of the carbon-fiber-precursor acrylic fiber so that the fiber is easier to draw. The steam temperature is set at 120~167° C. The plasticization effect is achieved with saturated steam of 120° C. or higher, but it is difficult to use saturated steam of 167° C. or higher in view of practical applications.

Figure 5:
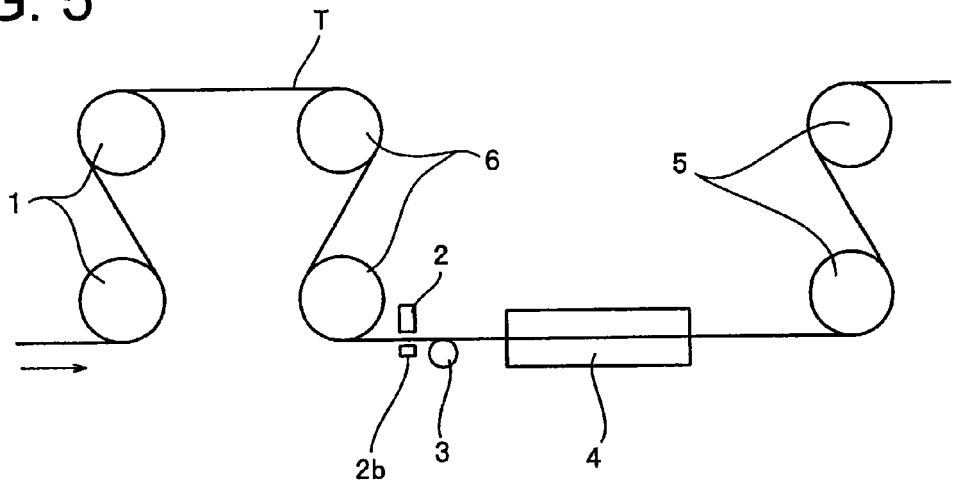
FIG. 5: a side view schematically showing the entire structure of a steam-drawing apparatus according to yet another embodiment of the present invention.
Figure 6:
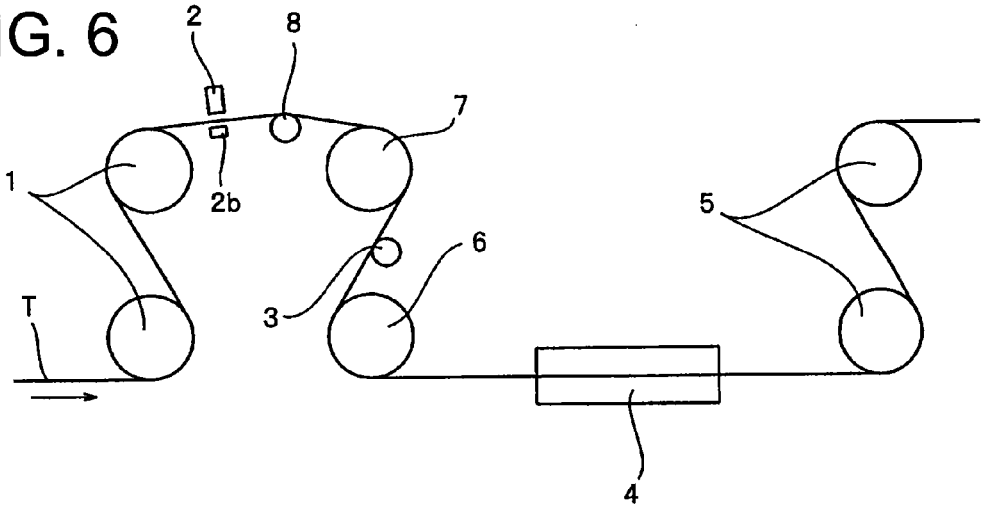
FIG. 6: a side view schematically showing the entire structure of a steam-drawing apparatus according to yet another embodiment of the present invention.

In the drawing apparatus of the present embodiment, transfer roll 7 may be set as hot roll 6 as shown in FIGS. 4~6. For that purpose, the number of hot rolls 6 and their positions are determined freely. Providing hot roll 6 is preferred since that makes it easier to raise the temperature of carbon-fiber-precursor acrylic fiber, which then makes it easier to draw the fiber in the steam box.

In the drawing apparatus of the present embodiment, the temperature of carbon-fiber-precursor acrylic fiber bundle (T) is preliminarily raised to 80~160° C. using hot roll 6. Raising the temperature of carbon-fiber-precursor acrylic fiber to 80° C. or higher is preferred because drawing the fiber in the steam box is easier, and the fiber temperature is preferred to be kept at 160° C. or lower because that can suppress the fiber from being drawn before entering the steam box.

In width control device 3, the width of carbon-fiber-precursor acrylic fiber bundle (T) after passing through width control device 3 is controlled to be at 65~110% of the width of carbon-fiber-precursor acrylic fiber bundle (T) before entering supply roll 1.

To achieve a uniform plasticization effect by steam on the entire fiber bundle in steam box 4, it is preferred that the thickness of carbon-fiber-precursor acrylic fiber bundle (T) be as uniform as possible and the fiber bundle not become too thick.

To set the width of carbon-fiber-precursor acrylic fiber bundle (T) after passing through width control device 3 to be at least 65% of the width of carbon-fiber-precursor acrylic fiber bundle (T) before it enters supply roll 1, it is preferred to uniformly plasticize carbon-fiber-precursor acrylic fiber bundle (T) by steam. On the other hand, if the width of carbon-fiber-precursor acrylic fiber bundle (T) is widened in fiber-opening device 2, carbon-fiber-precursor acrylic fiber bundle (T) may split or the like, and such a situation needs to be prevented. If the width of carbon-fiber-precursor acrylic fiber bundle (T) is set to be no more than 110%, more preferably no more than 100%, of its fiber width before the bundle enters supply roll 1, it is easier to suppress carbon-fiber-precursor acrylic fiber bundle (T) from splitting.

Well-known methods may be used for the steam conditions or a sealing device (not shown) in the steam box.

EXAMPLES

Examples of the present invention are described in the following.

Measurements and evaluations of various data in examples and comparative examples below were conducted as follows. The results of examples and comparative examples are shown in Tables 1 and 2.

[Measurement and Evaluation]

<Measuring Width of Carbon-Fiber-Precursor Acrylic Fiber Bundle>

The width of a carbon-fiber-precursor acrylic fiber bundle before entering a supply roll was measured at a position 100 mm upstream from the supply roll using a 150 mm-grade 1 ruler which complies with JIS B7516. Also, using the same ruler, the width of the carbon-fiber-precursor acrylic fiber bundle after being opened was measured at a position 50 mm downstream from the fiber-opening device, and the bundle width after passing through the width control device was measured at a position 50 mm downstream from the width control device.

<Moving Stability>

At a position 100 mm upstream from the entrance to the steam box, the width of a carbon-fiber-precursor acrylic fiber bundle was measured using a 150 mm-grade 1 ruler complying with JIS 137516 until 5000-m yarn was obtained. The variation in the measured fiber bundle widths was obtained from the maximum width and minimum width [maximum width−minimum width], and the variation rate was calculated by the formula: [variation]/[maximum width]×100(%). When the variation rate was 20% or greater, or cracking was observed in the fiber bundle, it was evaluated as "×," and when the variation rate was smaller than 20% and moving stability was maintained, it was evaluated as "○".

<Measuring Fiber Bundle Temperature>

The temperature of a carbon-fiber-precursor acrylic fiber bundle when exiting the hot roll was measured at a position 100 mm downstream from the roll using a radiation thermometer.

The temperature of the carbon-fiber-precursor acrylic fiber bundle when entering the steam box was measured at a position 100 mm upstream from the steam box by using a radiation thermometer.

<Unevenness of Carbon-Fiber-Precursor Acrylic Fiber Bundle Thickness>

Using a two-dimensional laser displacement sensor (LJ-G200, made by Keyence Corporation), the thickness of a carbon-fiber-precursor acrylic fiber bundle on a roll surface shortly before the bundle entered the steam box was measured for 100 meters in a direction in which the carbon-fiber-precursor acrylic fiber bundle was moving. When the unevenness of the thickness of a carbon-fiber-precursor acrylic fiber bundle in a width direction was no greater than ±0.05 mm, it was evaluated as "○," and when the unevenness was ±0.05 mm~0.08 mm, it was evaluated as "Δ," and when the unevenness exceeded ±0.08 mm, it was evaluated as "×".

<Number of Fuzzy Fibers>

A carbon-fiber-precursor acrylic fiber bundle was observed for 5 minutes after it passed through a haul-off roll, and the fuzzy fibers were counted as they passed.

<Quality>

When the number of fuzzy fibers had been observed for 5 minutes, it was evaluated as "○" if the number was no greater than 1, and as "Δ" if the number was at least 2 but no greater than 4, and as "×" if the number was at least 5.

Example 1

A polymer made of 98 mass % of acrylonitrile and 2 mass % of methacrylic acid with an intrinsic viscosity [η]=1.8 was dissolved in dimethylformamide to prepare a spinning stock solution with a polymer concentration of 23 mass %. The spinning stock solution was filtered through 20-μm and 5-μm filters, and its temperature was kept at 65° C. Then, using a die with a 0.15-mm diameter and having 2000 holes, coagulated fiber was obtained by a dry-wet spinning method. The spinning stock solution was introduced to a coagulation bath under the following conditions: ratio of dimethylformamide to water at 79/21 (mass %), temperature at 15° C. and distance between the nozzle surface and the coagulation bath at 4.0 mm.

Six of the obtained coagulated fibers were put together to form a coagulated carbon-fiber-precursor acrylic fiber bundle of 12000 filaments, which was drawn in the air and washed in hot water while being drawn further. Then, a silicone-based oil agent was applied and a dry-densification treatment was conducted to obtain a carbon-fiber-precursor acrylic fiber bundle of 12000 filaments.

The carbon-fiber-precursor acrylic fiber bundle was transferred by the supply roll to go through the fiber-opening device, which has a fluid impingement plate and a fluid jet-spray nozzle with a 1-mm slit set to be 42 mm long in a width direction of a fiber bundle. The carbon-fiber-precursor acrylic fiber bundle was opened while pressurized air was blown from the fluid jet-spray nozzle at 400 NL/min and was transferred by transfer roll 7 to be introduced to the steam box. The distance was set at 350 mm between supply roll 1 and fiber-opening device 2, and the distance was 900 mm between fiber-opening device 2 and the transfer roll. The total fineness of the yarn on the supply roll was 35040 dtex, and the flow rate of the gas jet-sprayed from the fluid jet-spray nozzle was 11.5 NL/min per 1000 detx, and the flow speed was 159 m/sec. In addition, the diameter of supply roll 1 and transfer roll 7 was set at 352 mm, and the yarn wrap angle to supply roll 1 and transfer roll 7 was set at 122 degrees. The temperature of the carbon-fiber-precursor acrylic fiber bundle when it entered the steam box was 55° C. Meanwhile, the haul-off roll was rotated at a speed of four times the speed of the transfer roll to haul off the carbon-fiber-precursor acrylic fiber bundle. Accordingly, a carbon-fiber-precursor acrylic fiber bundle with a fineness of 0.73 dtex was obtained.

Figure 7:
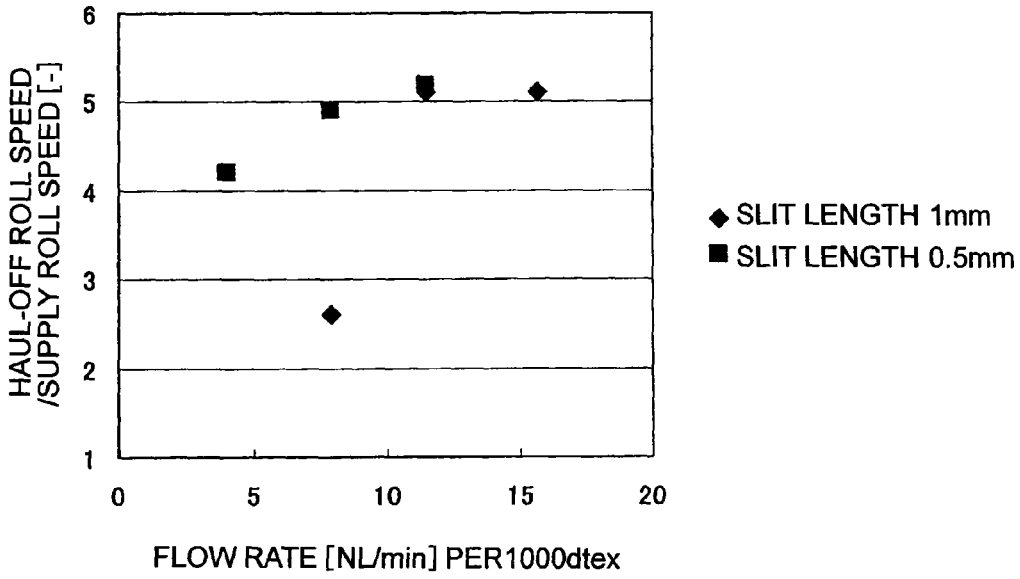
FIG. 7: a graph showing the correlation between the flow rate of gas from the fluid jet-spray nozzle of a fiber-opening device and the ratio of haul-off roll speed to supply roll speed in the event of fiber breakage.

At that time, the haul-off roll speed was gradually increased while the supply roll speed was set constant to obtain the ratio of haul-off roll speed to supply roll speed at the time of fiber breakage. The results are shown in FIG. 7. When the ratio of haul-off roll speed to supply roll speed at the time of fiber breakage is great, drawing the bundle through the steam box is shown to be easier.

Examples 2~4

Each carbon-fiber-precursor acrylic fiber bundle was obtained by the same procedures as in example 1 except that the slit length of the fluid jet-spray nozzle and the flow rate of the pressurized air were changed as shown in Table 1. The results are shown in Tables 1 and 2 and FIG. 7.

Example 5

A carbon-fiber-precursor acrylic fiber bundle was obtained by the same procedures as in example 1 except that the diameter of supply roll 1 and transfer roll 7 was changed to 500 mm. The results are shown in Tables 1 and 2.

Example 6

Figure 3:
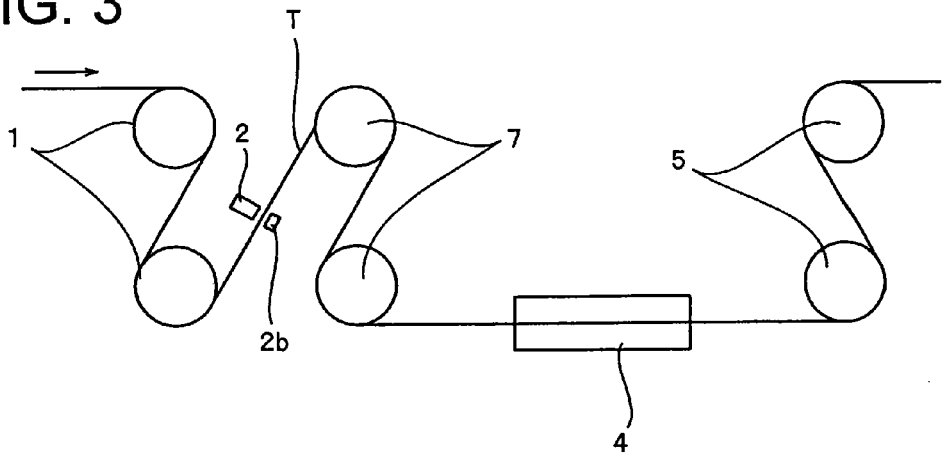
FIG. 3: a side view schematically showing the entire structure of a steam-drawing apparatus according to another embodiment of the present invention.

A carbon-fiber-precursor acrylic fiber bundle was obtained by the same procedures as in example 1 except that the yarn wrap angle to supply roll 1 and transfer roll 7 was changed to 193 degrees as shown in FIG. 3. The results are shown in Tables 1 and 2.

Example 7

A carbon-fiber-precursor acrylic fiber bundle was obtained by the same procedures as in example 1 except for the following procedures: a carbon-fiber-precursor acrylic fiber bundle was opened using fiber-opening device 2 as shown in FIG. 4; the bundle passed through the grooves of a free roll (width control device 3), positioned at 700 mm from fiber-opening device 2 in a bundle transfer direction and having a groove shape with a cross-sectional R36 arc formed in a circumferential direction, so that the width of the fiber bundle was controlled; and the bundle was transferred by hot roll 6 to enter the steam box. The results are shown in Tables 1 and 2.

Figure 8:
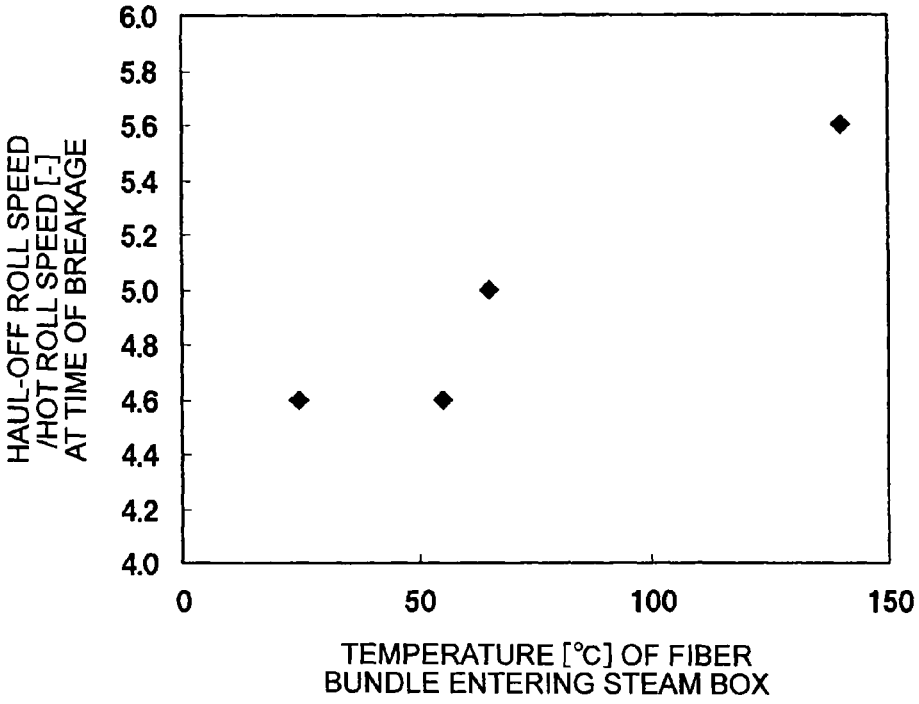
FIG. 8: a graph showing the correlation between the temperature of a carbon-fiber-precursor acrylic fiber bundle in a steam box and the ratio of haul-off roll speed to hot roll speed in the event of fiber breakage.

During the procedure in example 7, the temperature of hot roll 6 was changed so that the temperature of the carbon-fiber-precursor acrylic fiber bundle when entering the steam box was changed. The results are shown in Tables 1 and 2. In addition, the haul-off roll speed was gradually increased while the hot-roll speed was set constant to obtain the ratio of haul-off roll speed to hot roll speed at the time of bundle breakage. The results are shown in FIG. 8. When the ratio of haul-off roll speed to hot roll speed is great at the time of bundle breakage, drawing the bundle through the steam box is shown to be easier.

From the results above, it is found that drawing performance is enhanced if the temperature of a carbon-fiber-precursor acrylic fiber bundle when entering the steam box is 60° C. or higher.

In addition, by changing the temperature of a carbon-fiber-precursor acrylic fiber bundle when entering the steam box, and by setting a haul-off speed of the bundle to be four times that of the hot roll speed, the speed of the bundle on entering the steam box was measured using a rotation speedometer. Accordingly, the ratio of the entering speed of the bundle into the steam box to the exiting speed from the hot roll was obtained.

Figure 9:
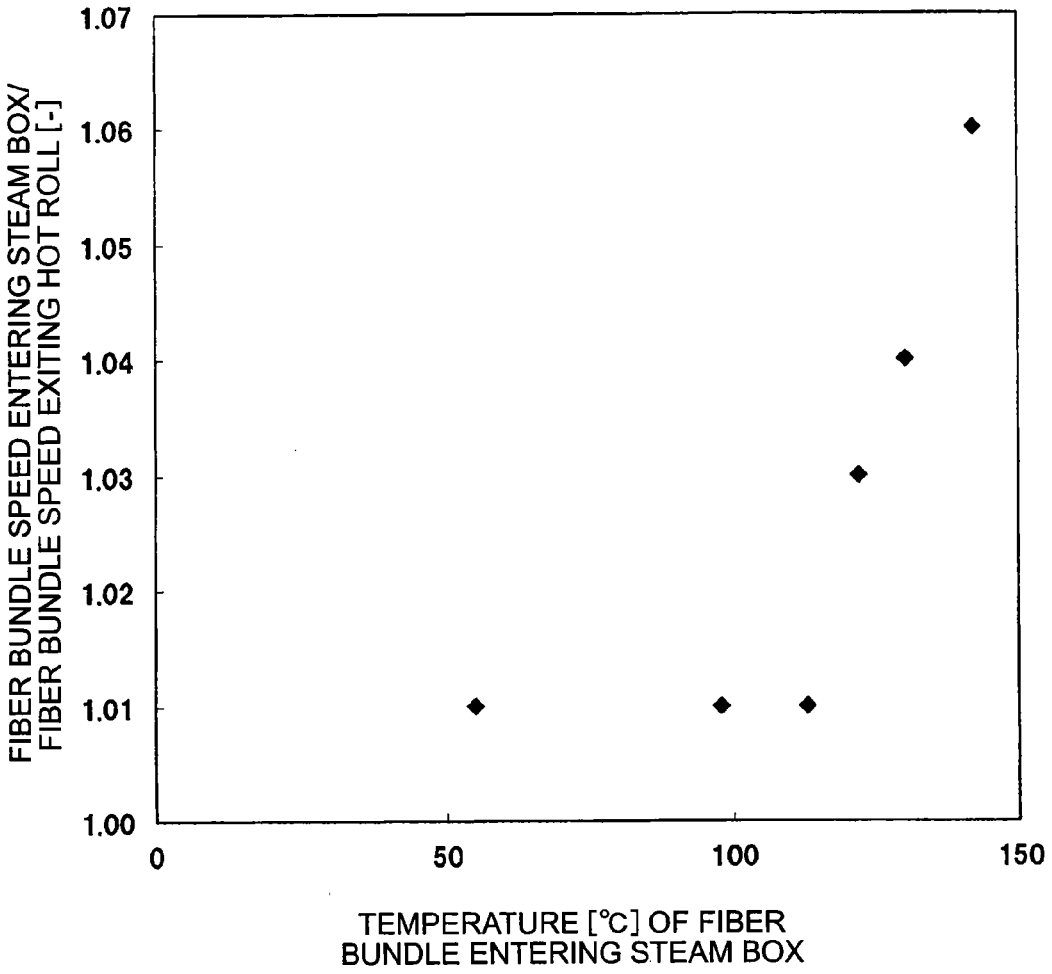
FIG. 9: a graph showing the correlation between the temperature of a carbon-fiber-precursor acrylic fiber bundle in a steam box and the ratio of fiber bundle speed in the steam box to hot roll speed.

The results are shown in FIG. 9. From the results, when the temperature of a carbon-fiber-precursor acrylic fiber bundle on entering the steam box is increased, the bundle is also drawn before entering the steam box.

Example 8

A carbon-fiber-precursor acrylic fiber bundle was obtained by the same procedures as in example 7 except that the final fineness was changed. The results are shown in Tables 1 and 2.

Example 9

A carbon-fiber-precursor acrylic fiber bundle was obtained by the same procedures as in example 8 except that the ratio of haul-off speed to supply roll speed was set at 3. The results are shown in Tables 1 and 2.

Example 10

A carbon-fiber-precursor acrylic fiber bundle was obtained by the same procedures as in example 7 except that a fixed guide with a groove in a cross-sectional arc shape was used as width control device 3. The results are shown in Tables 1 and 2.

Example 11

A carbon-fiber-precursor acrylic fiber bundle was obtained by the same procedures as in example 7 except that the groove shape of width control device 3 was changed. The results are shown in Tables 1 and 2.

Example 12

A carbon-fiber-precursor acrylic fiber bundle was obtained by the same procedures as in example 7 except that the final spinning speed was changed to 300 mm/min. The results are shown in Tables 1 and 2.

Example 13

A carbon-fiber-precursor acrylic fiber bundle was obtained by the same procedures as in example 12 except that the ratio of haul-off roll speed to supply roll speed was changed to 3.5. The results are shown in Tables 1 and 2.

Example 14

By bundling three coagulated fibers obtained the same as in example 1, a coagulated yarn of 6000 filaments for a carbon-fiber-precursor acrylic fiber bundle was prepared. Then, using a fiber-opening device having a fluid impingement plate and a fluid jet-spray nozzle with a 1-mm slit set to be 23 mm long in a fiber width direction, the bundle was drawn the same as in example 7 to obtain a carbon-fiber-precursor acrylic fiber bundle. The results are shown in Tables 1 and 2.

Example 15

A carbon-fiber-precursor acrylic fiber bundle was obtained by the same procedures as in example 7 except that width control device 3 having a roll with a smaller curvature rate was used. The results are shown in Tables 1 and 2.

Examples 16~18

Each carbon-fiber-precursor acrylic fiber bundle was obtained by the same procedures as in example 7 except that the distance between fiber-opening device 2 and width control device 3 was changed as shown in Tables 1 and 2. The results are shown in Tables 1 and 2.

Example 19

As shown in FIG. 10, a carbon-fiber-precursor acrylic fiber bundle was obtained by the same procedures as in example 19 except that the distance between fiber-opening device 2 and width control device 3 was changed to 400 mm, width (C) of the opened bundle was set at 24 mm, and, after the width control process, width (D) was set at 21 mm. The results are shown in Tables 1 and 2.

A carbon-fiber-precursor acrylic fiber bundle was obtained by the same procedures as in example 7 except that width control device 3 having a roll with a smaller curvature rate was used. The results are shown in Tables 1 and 2.

Comparative Example 1

A carbon-fiber-precursor acrylic fiber bundle was obtained by the same procedures as in example 1 except that the flow rate of pressurized air jet-sprayed from the fluid jet-spray nozzle was changed to 275 NL/min. The results are shown in Tables 1 and 2.

Comparative Example 2

An attempt was made to obtain a carbon-fiber-precursor acrylic fiber bundle by the same procedures as in example 1 except that the slit of the fluid jet-spray nozzle was changed to 0.5 mm and the flow rate of pressurized air was changed to 138 NL/min. However, yarn breakage occurred before the haul-off roll speed reached the desired roll speed, and no cf* bundle was obtained.

Comparative Example 3

A carbon-fiber-precursor acrylic fiber bundle was obtained by the same procedures as in example 7 except that a width control device having a roll with a smaller curvature rate was used. The results are shown in Tables 1 and 2.

Comparative Examples 4, 5

Each carbon-fiber-precursor acrylic fiber bundle was obtained by the same procedures as in example 14 except that a width control device having a roll with a smaller curvature rate was used. The results are shown in Tables 1 and 2.

TABLE 1

| | illustration | final fineness dtex | number of filaments | haul-off roll speed/supply roll speed | fiber bundle temp when entering steam box ° C. | final spinning speed m/min | aperture width (A) of fluid jet-spray nozzle mm | slit length of fluid jet-spray nozzle mm | flow rate NL/min | gas flow rate per 1000 dtex NL/min | flow speed m/s | diameter of supply roll mm | diameter of transfer roll mm | fiber bundle wrap angle to supply roll degree | fiber bundle wrap angle to transfer roll degree |
|---|---|---|---|---|---|---|---|---|---|---|---|---|---|---|---|
| example 1 | FIG. 1 | 0.73 | 12000 | 4 | 55 | 200 | 42 | 1 | 400 | 11.5 | 159 | 352 | 352 | 122 | 122 |
| example 2 | FIG. 1 | 0.73 | 12000 | 4 | 55 | 200 | 42 | 1 | 550 | 15.7 | 219 | 352 | 352 | 122 | 122 |
| example 3 | FIG. 1 | 0.73 | 12000 | 4 | 55 | 200 | 42 | 0.5 | 400 | 11.5 | 318 | 352 | 352 | 122 | 122 |
| example 4 | FIG. 1 | 0.73 | 12000 | 4 | 55 | 200 | 42 | 0.5 | 275 | 7.9 | 219 | 352 | 352 | 122 | 122 |
| example 5 | FIG. 1 | 0.73 | 12000 | 4 | 55 | 200 | 42 | 1 | 400 | 11.5 | 159 | 500 | 500 | 127 | 127 |
| example 6 | FIG. 3 | 0.73 | 12000 | 4 | 55 | 200 | 42 | 1 | 400 | 11.5 | 159 | 352 | 352 | 193 | 193 |
| example 7 | FIG. 4 | 0.73 | 12000 | 4 | 98 | 200 | 42 | 1 | 475 | 13.6 | 189 | 352 | 352 | 122 | 122 |
| example 8 | FIG. 4 | 0.77 | 12000 | 4 | 98 | 200 | 42 | 1 | 475 | 13.6 | 189 | 352 | 352 | 122 | 122 |
| example 9 | FIG. 4 | 0.77 | 12000 | 3 | 98 | 200 | 42 | 1 | 475 | 13.6 | 189 | 352 | 352 | 122 | 122 |
| example 10 | FIG. 4 | 0.73 | 12000 | 4 | 98 | 200 | 42 | 1 | 475 | 13.6 | 189 | 352 | 352 | 122 | 122 |
| example 11 | FIG. 4 | 0.73 | 12000 | 4 | 98 | 200 | 42 | 1 | 475 | 13.6 | 189 | 352 | 352 | 122 | 122 |
| example 12 | FIG. 4 | 0.73 | 12000 | 4 | 98 | 300 | 42 | 1 | 475 | 13.6 | 189 | 352 | 352 | 122 | 122 |
| example 13 | FIG. 4 | 0.73 | 12000 | 3.5 | 98 | 300 | 42 | 1 | 475 | 15.5 | 189 | 352 | 352 | 122 | 122 |
| example 14 | FIG. 4 | 0.73 | 6000 | 4 | 98 | 200 | 23 | 1 | 238 | 13.6 | 173 | 352 | 352 | 122 | 122 |
| example 15 | FIG. 4 | 0.73 | 6000 | 4 | 98 | 200 | 23 | 1 | 238 | 13.6 | 173 | 352 | 352 | 122 | 122 |
| example 16 | FIG. 4 | 0.73 | 12000 | 4 | 55 | 200 | 42 | 1 | 475 | 13.6 | 189 | 352 | 352 | 122 | 122 |
| example 17 | FIG. 4 | 0.73 | 12000 | 4 | 55 | 200 | 42 | 1 | 475 | 13.6 | 189 | 352 | 352 | 122 | 122 |
| example 18 | FIG. 4 | 0.73 | 12000 | 4 | 55 | 200 | 42 | 1 | 475 | 13.6 | 189 | 352 | 352 | 122 | 122 |
| example 19 | FIG. 6 | 0.73 | 12000 | 4 | 55 | 200 | 42 | 1 | 475 | 13.6 | 189 | 352 | 352 | 122 | 122 |
| comparative example 1 | FIG. 1 | 0.73 | 12000 | 4 | 55 | 200 | 42 | 1 | 275 | 7.9 | 110 | 352 | 352 | 122 | 122 |
| comparative example 2 | FIG. 1 | 0.73 | 12000 | 4 | 55 | 200 | 42 | 0.5 | 138 | 4 | 110 | 352 | 352 | 122 | 122 |
| comparative example 3 | FIG. 4 | 0.73 | 12000 | 4 | 98 | 200 | 42 | 1 | 475 | 13.6 | 189 | 352 | 352 | 122 | 122 |
| comparative example 4 | FIG. 4 | 0.73 | 6000 | 4 | 98 | 200 | 23 | 1 | 238 | 13.6 | 173 | 352 | 352 | 122 | 122 |
| comparative example 5 | FIG. 4 | 0.73 | 6000 | 4 | 98 | 200 | 23 | 1 | 238 | 13.6 | 173 | 352 | 352 | 122 | 122 |

TABLE 2

| | shape of with control device | distance betw. fiber opening device 2 and width control device 3 or flat roll 8 mm | fiber bundle width (B) before entering supply roll mm | fiber bundle (C) after fiber opening mm | (A)/(C) × 100 | fiber bundle (D) after width control mm | (D)/(B) × 100 % | bundle width variation after width control mm | variation rate of bundle width % | moving stability | thickness variation of fiber bundle on roll shortly before steam box | number of fuzz per 5 min | quality |
|---|---|---|---|---|---|---|---|---|---|---|---|---|---|
| example 1 | — | — | 22 | 26 | 1.7 | — | — | — | — | ○ | ○ | 2 | ○ |
| example 2 | — | — | 22 | 26 | 1.7 | — | — | — | — | ○ | ○ | 1 | ○ |

TABLE 2-continued

| | shape of with control device | distance betw. fiber opening device 2 and width control device 3 or flat roll 8 mm | fiber bundle width (B) before entering supply roll mm | fiber bundle (C) after fiber opening mm | (A)/(C) × 100 | fiber bundle (D) after width control mm | (D)/(B) × 100 % | bundle width variation after width control mm | variation rate of bundle width % | moving stability | thickness variation of fiber bundle on roll shortly before steam box | number of fuzz per 5 min | quality |
|---|---|---|---|---|---|---|---|---|---|---|---|---|---|
| example 3 | — | — | 22 | 26 | 1.7 | — | — | — | — | ○ | ○ | 1 | ○ |
| example 4 | — | — | 22 | 26 | 1.7 | — | — | — | — | ○ | ○ | 2 | ○ |
| example 5 | — | — | 22 | 26 | 1.7 | — | — | — | — | ○ | ○ | 2 | ○ |
| example 6 | — | — | 22 | 26 | 1.7 | — | — | — | — | ○ | ○ | 2 | ○ |
| example 7 | R36 circular roll | 400 | 22 | 24 | 1.8 | 19 | 86 | 1.5 | 8 | ○ | ○ | 0 | ○ |
| example 8 | R36 circular roll | 400 | 23 | 25 | 1.7 | 21 | 91 | 1.5 | 7 | ○ | ○ | 0 | ○ |
| example 9 | R36 circular roll | 400 | 20 | 22 | 2 | 16 | 80 | 1 | 6 | ○ | ○ | 1 | ○ |
| example 10 | R36 circular roll | 400 | 22 | 24 | 1.8 | 23 | 105 | 2 | 9 | ○ | ○ | 1 | ○ |
| example 11 | elliptical roll 36 long axis, 30 short axis | 400 | 22 | 24 | 1.8 | 18 | 82 | 1.5 | 8 | ○ | ○ | 1 | ○ |
| example 12 | R36 circular roll | 400 | 27 | 30 | 1.4 | 21 | 78 | 3 | 14 | ○ | ○ | 1 | ○ |
| example 13 | R36 circular roll | 400 | 27 | 29 | 1.5 | 20 | 74 | 2 | 10 | ○ | ○ | 1 | ○ |
| example 14 | R36 circular roll | 400 | 15 | 18 | 1.3 | 14 | 93 | 1.5 | 11 | ○ | ○ | 1 | ○ |
| example 15 | R36 circular roll | 400 | 15 | 18 | 1.3 | 10 | 67 | 1.5 | 15 | ○ | ○ | 1 | ○ |
| example 16 | R36 circular roll | 50 | 22 | 24 | 1.8 | 20 | 91 | 1 | 3 | ○ | ○ | 0 | ○ |
| example 17 | R36 circular roll | 650 | 22 | 24 | 1.8 | 17 | 77 | 1 | 6 | ○ | ○ | 1 | ○ |
| example 18 | R36 circular roll | 900 | 22 | 25 | 1.7 | 16 | 73 | 2 | 8 | ○ | Δ | 1 | ○ |
| example 19 | R36 circular roll | 400 | 22 | 24 | 1.8 | 21 | 95 | 1.5 | 7 | ○ | ○ | 1 | ○ |
| comparative example 1 | — | — | 22 | 23 | 1.9 | — | — | — | — | x | ○ | 8 | Δ |
| comparative example 2 | — | — | 22 | 23 | 1.9 | — | — | — | — | — | — | — | — |
| comparative example 3 | R12 circular roll | 400 | 22 | 24 | 1.8 | 9 | 41 | 1 | 4 | ○ | x | 5 | x |
| comparative example 4 | R12 circular roll | 400 | 15 | 18 | 1.3 | 8 | 53 | 1 | 13 | ○ | ○ | 3 | Δ |
| comparative example 5 | R18 circular roll | 400 | 15 | 18 | 1.3 | 9 | 60 | 1 | 11 | ○ | ○ | 2 | Δ |

DESCRIPTION OF NUMERICAL REFERENCES

1 supply roll
2 fiber-opening device
2*a* nozzle aperture
2*b* fluid impingement plate
3 width control device (grooved roll)
4 steam box
5 haul-off roll
6 hot roll
7 transfer roll
8 flat roll (flat free roll)

What is claimed is:

1. A method for producing a carbon-fiber-precursor acrylic fiber bundle, the method comprising:

opening a carbon-fiber-precursor acrylic fiber bundle using a fiber-opening device by jet-spraying fluid from a fluid jet-spray nozzle; and introducing the carbon-fiber-precursor acrylic fiber bundle into a steam box for heating, wherein a gas is used as the jet-sprayed fluid from the fluid jet-spray nozzle, a flow rate of the gas is at least 7 NL/min but at most 16 NL/min per 1000 dtex, and a flow speed of the gas is at least 130 m/sec but at most 350 m/sec so that the fluid penetrates through the carbon-fiber precursor acrylic fiber bundle, and wherein by controlling a width of the carbon-fiber-precursor acrylic fiber bundle via a width control device positioned after the fiber opening device, a width of the carbon-fiber-precursor acrylic fiber bundle immediately after the fiber bundle passes through the width control device is set at 65 to 110% of a width of the fiber bundle immediately before the fiber bundle enters a supply roll, and then the carbon-fiber-precursor acrylic fiber bundle enters the steam box.

2. The method according to claim 1, wherein a nozzle aperture of the fluid jet-spray nozzle is shaped rectangular to be long in a width direction of the carbon-fiber-precursor acrylic fiber bundle, and a ratio of a width of the nozzle aperture of the fluid jet-spray nozzle W1 to a width of the fiber bundle on a roll positioned immediately before the fiber-opening device W2 is at least 1.2 but at most 2.0.

3. The method according to claim 1, wherein a wrap angle of the carbon-fiber-precursor acrylic fiber bundle to rolls positioned immediately before and after the fiber-opening device is set to be at least 90 degrees but at most 200 degrees.

4. The method according to claim 1, wherein rolls positioned before and after the opening device have a diameter of at least 300 mm but at most 600 mm.

5. The method according to claim 1, wherein the fiber-opening device comprises a fluid impingement plate positioned in a direction at which a fluid is jet-sprayed from the fluid jet-spray nozzle.

6. The method according to claim 1, wherein the width control device is a grooved roll which has grooves formed in a circumferential direction and is positioned at least 50 mm but at most 1000 mm away from the fiber-opening device in a fiber transfer direction;

the grooves which make contact with both end portions in a width direction of the carbon-fiber-precursor acrylic fiber bundle are shaped to be a cross-sectional part of an arc or ellipse.

7. The method according to claim 6, wherein after passing through the width control device, the carbon-fiber-precursor acrylic fiber bundle is heated by a hot roll to have a temperature of 80~160° C. before said introducing.

8. The method according to claim 6, wherein the grooved roll is a rotating roll.

9. The method according to claim 6, wherein a flat roll is positioned between the fiber-opening device and the width control device.

10. The method according to claim 1, wherein the flow rate of the gas is at least 10 NL/min but at most 14 NL/min per 1000 dtex.

11. The method according to claim 1, wherein the flow speed of the gas is at least 150 m/sec but at most 320 m/sec.

12. The method according to claim 1, wherein the flow speed of the gas is at least 130 m/sec but at most 230 m/sec.

13. The method according to claim 1, wherein the gas is air.

14. The method according to claim 1, wherein the width control device is a rotary driver roll, free roll or fixed roll with grooves formed parallel to a circumferential direction, or a guide with grooves formed thereon.

15. The method according to claim 1, wherein steam is supplied to the steam box, wherein the steam is set to a temperature of 120 to 167° C.

16. The method according to claim 1, wherein the acrylic fiber is composed of an acrylonitile-based homopolymer or an acrylonitrile-based copolymer.

17. The method according to claim 1, wherein the acrylic fiber is composed of acrylonitrile units and methacrylic acid units.

* * * * *